United States Patent [19]

Kapuscinski et al.

[11] Patent Number: 4,836,943

[45] Date of Patent: Jun. 6, 1989

[54] ANTI-OXIDANT SYSTEM

[75] Inventors: Maria M. Kapuscinski, Carmel; Christopher S. Liu, Poughkeepsie; Ronald E. Jones, Glenham; Larry D. Grina, Hopewell, all of N.Y.

[73] Assignee: Texaco Inc., White Plains, N.Y.

[21] Appl. No.: 73,612

[22] Filed: Jul. 15, 1987

[51] Int. Cl.[4] ..... C10M 133/40; C10M 129/10

[52] U.S. Cl. ..... 252/50; 252/52 R; 252/401; 252/403; 252/404; 252/405; 252/407

[58] Field of Search ..... 252/50, 401, 403, 404, 252/405, 407

[56] References Cited

U.S. PATENT DOCUMENTS

| | | | |
|---|---|---|---|
| 3,423,367 | 1/1969 | Merijam et al. | 252/50 |
| 3,480,635 | 11/1969 | Altwicker | 252/50 |
| 3,900,410 | 8/1975 | Malec | 252/50 |
| 4,024,186 | 5/1977 | Dounchis | 252/50 |
| 4,116,874 | 9/1978 | Sugiura et al. | 252/50 |
| 4,189,587 | 2/1980 | Holt et al. | 252/49.9 |
| 4,280,894 | 7/1981 | Taylor | 44/72 |
| 4,330,302 | 5/1982 | Taylor | 252/50 |
| 4,347,148 | 8/1982 | Davis | 252/50 |
| 4,640,788 | 2/1987 | Kapuscinski et al. | 252/51.5 A |

*Primary Examiner*—William R. Dixon, Jr.
*Assistant Examiner*—Ellen M. McAvoy
*Attorney, Agent, or Firm*—Robert A. Kulason; James J. O'Loughlin; Vincent A. Mallare

[57] ABSTRACT

An oil containing a viscosity index improver of improved oxidative stability contains, as an anti-oxidant system 2,6-di-t-butylphenol and 1-(3-aminopropyl)-2-pipecoline.

19 Claims, No Drawings

ANTI-OXIDANT SYSTEM

FIELD OF THE INVENTION

This invention relates to hydrocarbon liquids containing an anti-oxidant system. More particularly it relates to an oil containing a viscosity index improver and an anti-oxidant system.

BACKGROUND OF THE INVENTION

As is well known to those skilled in the art, middle distillate hydrocarbons and lubricating oils are commonly employed under conditions wherein their oxidation stability is a significant factor. In the case of lubricating oils for example the properites of the oil may be significantly changed when the oil is subjected to oxidation. Typically the oil may become darker, thicker, and it may decompose to a mixture containing a larger concentration of solids. When the lubricating oil contains additives such as viscosity index improvers for example, it is found that many of these additives are particularly susceptible to oxidation; and their effectivity is diminished as they are oxidized during operation.

It is an object of this invention to provide an anti-oxidant system which is particularly characterized by its ability to function in hydrocarbon oils. Other objects will be apparent to those skilled in the art.

STATEMENT OF THE INVENTION

In accordance with certain of its aspects, this invention is directed to an anti-oxidant composition comprising a hindered phenol; and a pipecoline.

DESCRIPTION OF THE INVENTION

The first component which may be present in the composition of this invention is a hindered phenol. A hindered phenol is an aromatic compound including an aryl ring: anthracene, naphthalene, or preferably a benzene ring-bearing at least one phenol —OH group thereon. It also includes at least one and preferably two hindering R groups adjacent to the phenol hydroxy group. These hindering R groups may be alkyl, alkaryl, aralkyl, cycloalkyl, aryl, etc. groups.

In the above compound, R may typically be a hydrocarbon group selected from the group consisting of alkyl, aralkyl, cycloalkyl, aryl, and alkaryl including such radicals when inertly substitued. When R is alkyl, it may typically be methyl, ethyl, n-propyl, iso-propyl, n-butyl, i-butyl, sec-butyl, amyl, octyl, decyl, octadecyl, etc. When R is aralkyl, it may typically be benzyl, beta-phenyl-ethyl, etc. When R is cycloalkyl, it may typically be cyclohexyl, cycloheptyl, cyclooctyl, 2-methylcycloheptyl, 3-butylcyclohexyl, 3-methylcyclohexyl, etc. When R is aryl, it may typically be phenyl, naphthyl, etc. When R is alkaryl, it may typically be tolyl, xylyl, etc. R may be inertly substituted i.e. it may bear a non-reactive substituent such as alkyl, aryl, cycloalkyl, ether, etc. Typical inertly substituted R groups may include 2-ethoxyethyl, carboethoxymethyl, 4-methyl cyclohexyl, etc. The preferred R groups may be lower alkyl, i.e. $C_1$–$C_8$ alkyl, groups including eg methyl, ethyl, n-propyl, i-propyl, butyls, amyls, hexyls, octyls, decyls, etc.

The typical hindered phenol may have the formula:

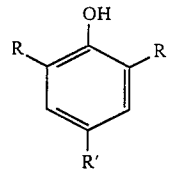

Commonly R is a branched chain alkyl group containing about 1–10 carbon atoms. R may for example be isopropyl, t-butyl, sec-butyl, isobutyl, sec-amyl, t-amyl, isoamyl, and corresponding branched hexyl, heptyl, octyl, decyl, etc. Both R groups are commonly the same. Preferred R groups may be branched chain alkyl groups containing 1–8, say 3–5 carbon atoms. Most preferred is t-butyl.

R' may be hydrogen or selected from the same group as that from which R is selected. It may be branched or straight chain. Preferably R' may be a $C_1$–$C_{14}$ alkyl radical, such as t-butyl.

Commonly the hindering groups may be lower ($C_1 \propto C_{10}$) alkyl groups and most commonly they will be groups which occupy a substantial volume of space. Typical hindering groups may be isopropyl, isobutyl, t-butyl, iso-amyl, t-amyl, etc. Hindered phenols which are most readily available commercially include t-butyl groups.

Typical hindered phenols may be those set forth below in Table I, the first listed being most preferred:

TABLE I 2,6-di-t-butyl phenol
2,6-di-t-butyl-4-methyl phenol
2,6-di-t-amyl-p-cresol
2,6-di-t-butyl-p-cresol
2,6-di-isopropyl-4-ethylphenol
2,6-di-t-butyl-4-nonylphenol
2,4,6-tri-isopropylphenol
2-t-butyl-4,6-di-isopropylphenol
2,4,6-tri-t-butyl phenol
2,6-di-isoamyl-4-ethylphenol
2,6-di-t-amyl-4-n-amylphenol
2,6-di-isobutyl-p-cresol
2,6-di-sec-butyl-4-n-propylphenol
2,6-di-t-amylphenol
2,6-di-isobutylphenol
2,b-di-t-butyl-4-hydroxymethylphenol Preferred hindered phenols may include 2,6-di-t-butylphenol; 2,6-di-t-butyl cresol; and 2,4,6-tri-isopropylphenol; 2,6,di-t-butyl-4-methylphenol; 2,4,6-tri-t-butylphenol; and 2,6-di-t-butyl-4-hydroxymethylphenol.

The second component which may be present in the composition of this invention may be a pipecoline:

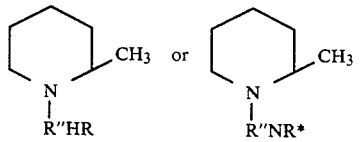

The preferred composition may be an 1-(3-aminopropyl)-2-pipecoline

R* may be hydrogen or selected from the same group as R.

In the above formula, R'' may be a hydrocarbon group selected from the group consisting of alkylene, aralkylene, cycloalkylene, arylene, and alkarylene, including such radicals when inertly substituted. When R'' is alkylene, it may typically be methylene, ethylene, n-propylene, iso-propylene, n-butylene, i-butylene, sec-butylene, amylene, octylene, decylene, octadecylene, etc. When R'' is aralkylene, it may typically be benzylene, beta-phenylethylene, etc. When R'' is cycloalkylene, it may typically be cyclohexylene, cycloheptylene, cyclooctylene, 2-methylcycloheptylene, 3-butylcyclohexylene, 3-methylcyclohexylene, etc. When R'' is arylene, it may typically be phenylene, naphthylene, etc. When R'' is alkarylene, it may typically be tolylene, xylylene, etc. R'' may be inertly substituted i.e. it may bear a non-reactive substituent such as alkyl, aryl, cycloalkyl, ether, etc. Typically inertly substituted R'' groups may include 3-chloropropylene, 2-ethoxyethylene, carboethoxymethylene, 4-methyl cyclohexylene, etc. The preferred R'' groups may be lower alkylene, i.e. $C_1$–$C_{10}$ alkylene, groups including eg methylene, ethylene, n-propylene, i-propylene, butylene, amylene, hexylene, octylene, decylene, etc. R'' may preferably be ethylene —$CH_2CH_2$—.

Typical second components may include those set forth below in Table II:

TABLE II 1-(3-aminopropyl)-2-pipecoline
1-(3-aminopropyl)-3-pipecoline
1-(aminoethyl)-2-pipecoline The preferred second component may be the first listed above in Table II.

The anti-oxidant compositions of this invention may contain 0.8–1.2 moles, preferably 0.9–1.1 moles, say 1 mole of hindered phenol first component per mole of N-aminohydrocarbyl pipecoline second component. In the preferred embodiment, the composition may contain 1 mole of 2,6-di-t-butylphenol per 1.2 mole of [1(3-aminopropyl)2-pipecoline]. This may typically correspond to 0.5–8 parts, say 4.7 parts of 2,6-di-t-butylphenol first component and 1–6.0 parts, say 3.5 parts of pipecoline second component per 1000 parts of oil—corresponding to a total of 1.5–12, say 8.2 parts per 1000 parts of oil which may contain a viscosity index improver.

The hydrocarbon oils in which these anti-oxidant compositions may find particular use may include middle distillate oils or lubricating oils. Middle distillate hydrocarbon oils are particularly characterized by an ibp of 350° F.–400° F., say 360° F.; a 50% bp of 450° F.–550° F., say 500° F.; an ep of 600° F.–700° F., say 630° F.; and an API Gravity of 33–40, preferably 35–38, say 36. These hydrocarbons may commonly be identified as jet fuel avjet fuel, kerosene, fuel oil, gas oil, etc.

The middle distillate or lubricating oils may contain effective anti-oxidant amounts (per 1000 parts of oil) of 0.5–8 preferably 1–6, say 4.7 parts of phenol first component and 1–8, preferably 2–5 say 3.5 parts—per 1000 parts of oil.

Lubricating oils in which the anti-oxidant systems of this invention may find use include automotive, aircraft, marine, railway, etc.; compression ignition or spark ignition; winter or summer; oils. Typically the lubricating oils may be characterized by an ibp of 570° F.–660° F., say 610° F.; a 50% bp of 660° F.–930° F., say 790° F., say 790° F.; an ep of 750° F.–1020° F., say 880° F.; and API gravity of 25–31, preferably 28–30, say 29.

It is a feature of this invention that the anti-oxidant system may permit attainment of desirable results in lubricating oil systems which contain viscosity index improvers (VII). Typical the viscosity index improvers which may be present in formulations of this invention include olefin copolymers (such as ethylene-propylene copolymers), acrylates (including polymers and copolymers of methyl acrylate, methyl methacrylate), etc.

These viscosity index improvers may be present in the lubricating oil compositions in effective viscosity index improving amount of 6–14 w%, preferably 6.75–13.50 w%, say 6.75 w%.

A typical composition may be 100 parts of a SAE 10W-30 lubricating oil containing 6.75 parts of an effective viscosity index improving amount of ethylene-propylene copolymer (of $\overline{M}_n$ of 130,000 and a polydispersity of 1.8) as a viscosity index improver and 0.47 parts of 2,6-di-t-butyl phenol and 0.35 parts of 1-3-aminopropylpipecoline).

The oxidative stability of the compositions of this invention may be determined by a Standard Test which correlates with the Sequence III D Engine Test.

In this engine test, samples containing 1.5 w% polymer in SNO-130 oil are heated and stirred for 144 hours while air is blown therethrough. Aliquots are removed periodically for Differential Infrared Absorption (DIR) studies. The oxidation stability of the samples may be determined by intensity of the carbonyl vibration band at 1710/cm relative to those determined by use of VII of known oxidation stability. As the oxidation increases, carbonyl absorption increases.

It is a particular feature of the systems of this invention that they provide oxidation resistance in the presence of rubber or plastic (e.g. Viton) materials (typically found in gaskets or hoses) with which, e.g., lubricating oils come into contact as they are used in automotive and other engines. It is found that the ability of an anti-oxidant system to prevent deterioration of rubber is a good index of its overall anti-oxidant ability.

It is found that use of the systems of this invention typically permits oxidation (as measured by DIR-absorbance/cm) to be maintained at a very low level of less than about three for up to about 160 hours. In contrast, control runs permits oxidation to occur at a high level of ca 12 after only 80 hours and up to 22 after 160 hours.

DESCRIPTION OF SPECIFIC EMBODIMENTS

Practice of this invention will be apparent to those skilled in the art from the following wherein, as elsewhere in this specification, all parts are parts by weight unless otherwise stated.

EXAMPLE I

In this example, 184 g of 9 wt.% solution of ethylene-propylene copolymer (EPM) in SNO-100 (Solvent Neutral Oil) is mixed with 0.47 g of Ethyl AN-701 (di-t-butylphenol) and 0.35 g of APP [1(3-aminopropyl)2-pipecoline] at temperature 80° C. Then, enough SNO-135 oil is added to get the polymer concentration about 1.5 wt.%. The mixture is then stirred at 150° C. while air is purged. Samples are withdrawn periodically for analysis by DIR. The test is completed after 144 hours of heating. The result reported, as Oxidation Index, indicates the change in the intensity of the carbonyl vibration bands at 1710-cm-1 after 144 hours of oxidation.

EXAMPLE II*

In this example, the procedure of Example I is followed except that APP is not added.

EXAMPLE III*

In this example the procedure of Example I is followed except that Ethyl AN-701 is not added.

EXAMPLE IV*

In this example the procedure of Example I is followed except that neither APP nor Ethyl-701 is added.

EXAMPLE V

In this example the procedure of Example I is followed except that instead of EMP solution, a pure SNO-100 oil is used.

The oxidation stability of the above examples is provided below in Table III.

TABLE III

OXIDATION STABILITY OF VI IMPROVERS

| Sample (g) | I | II* | III* | IV* | V |
|---|---|---|---|---|---|
| EPM | 10.0 | 10.0 | 10.0 | 10.0 | — |
| APP | 0.22 | — | 0.22 | — | 0.22 |
| Ethyl AN-701 | 0.28 | 0.28 | — | — | 0.28 |
| SNO-100 | 101.1 | 101.1 | 101.1 | 101.1 | 101.1 |
| SNO-130 | 555.6 | 555.6 | 555.6 | 555.6 | 555.6 |
| Oxidation Index(1) | 3.0 | 21.8 | 17.6 | 15.9 | 2.1 |

(1)Change in the intensity of the carbonyl vibration band at 1710 cm−1 after 144 hours of oxidation.

As seen in the table depicted above, samples of examples I and V containing both Ethyl An-701 and 1-(-3-aminopropyl)-2-pipecoline shows excellent oxidation stability while the remaining samples are not stable in the same conditions. This indicates that Ethyl AN-701 and APP form the synergistic antioxidant system in the oil and VI improver oil solution.

Although this inventon has been illustrated by reference to specific embodiments, it will be apparent to those skilled in the art that various changes and modifications may be made which clearly fall within the scope of this invention.

We claim:

1. An anti-oxidant composition comprising (a) a hindered phenol and (b) a N-aminohydrocarbyl pipecoline.

2. The anti-oxidant composition of claim 1, wherein said hindered phenol is 2,6-di-t-butylphenol.

3. The anti-oxidant composition of claim 1, wherein said hindered phenol is 2,6-di-t-butyl-4-methyl phenol.

4. The anti-oxidant composition of claim 1, wherein said hindered phenol is 2,6-di-t-butyl-4-hydroxymethyl phenol.

5. The anti-oxidant composition of claim 1, wherein said hindered phenol is 2,4,6-tri-t-butyl phenol.

6. The anti-oxidant composition of claim 1, wherein said N-aminohydrocarbyl pipecoline is 1-(3-aminopropyl)-2-pipecoline.

7. The antioxidant composition of claim 1, wherein said N-aminohydrocarbyl pipecoline is 1-(3-aminopropyl)-3-pipecoline.

8. The antioxidant composition of claim 1, wherein said N-aminohydrocarbyl pipecoline is 1-(aminoethyl)-2-pipecoline.

9. An anti-oxidant composition comprising:

(i) 2,6-di-t-butylphenol; and (ii) 1-(3-aminopropyl)-2-pipecoline.

10. A lubricating oil composition comprising:

(a) a major portion of a lubricating oil having a boiling point above 600° F. and (b) a minor effective antioxidant portion of, as an additive, a hindered phenol and a N-aminohydrocarbyl pipecoline.

11. The lubricating oil composition of claim 10, wherein said hindered phenol is 2,6-di-t-butyl phenol.

12. The lubricating oil composition of claim 10, wherein said hindered phenol is 2,6-di-t-butyl-4-methyl phenol.

13. A lubricating oil composition as claimed in claim 10, wherein said hindered phenol is 2,4,6-tri-t-butyl phenol.

14. A lubricating oil composition as claimed in claim 10, wherein said N-aminohydrocarbyl pipecoline is 1-(3-aminopropyl)-2-pipecoline.

15. A lubricating oil composition as claimed in claim 10, wherein said N-aminohydrocarbyl pipecoline is 1-(3-aminopropyl)-3-pipecoline.

16. A lubricating oil composition as claimed in claim 10, wherein said N-aminohydrocarbyl pipecoline is 1-(aminoethyl)-2-pipecoline.

17. A lubricating oil composition as claimed in claim 10, wherein said effective portion is 1.5–12 parts per 1000 parts of oil.

18. A lubricating oil composition as claimed in claim 10, wherein said effective portion is 5–10 parts per 1000 parts of oil.

19. A lubricating oil composition as claimed in claim 10, wherein said additive contains 0.4–12 moles of hindered phenol per mole of pipecoline.

* * * * *